US008459081B2

(12) United States Patent
Runyan

(10) Patent No.: US 8,459,081 B2
(45) Date of Patent: Jun. 11, 2013

(54) CONTINUOUSLY SMOOTHLY ADJUSTABLE AND SELF-ALIGNING VARIABLE WIDTH ROLL FORMING APPARATUS

(75) Inventor: Randy Runyan, Oxford, IA (US)

(73) Assignee: Mestek Machinery, Inc., Westfield, MA (US)

( * ) Notice: Subject to any disclaimer, the term of this patent is extended or adjusted under 35 U.S.C. 154(b) by 381 days.

(21) Appl. No.: 12/825,564

(22) Filed: Jun. 29, 2010

(65) Prior Publication Data

US 2010/0326160 A1 Dec. 30, 2010

Related U.S. Application Data

(60) Provisional application No. 61/221,277, filed on Jun. 29, 2009.

(51) Int. Cl.
*B21D 5/08* (2006.01)

(52) U.S. Cl.
USPC ..... 72/181; 72/176; 72/180; 72/182

(58) Field of Classification Search
USPC ..... 72/179–182
See application file for complete search history.

(56) References Cited

U.S. PATENT DOCUMENTS

| | | | | |
|---|---|---|---|---|
| 819,644 | A * | 5/1906 | Flatau | 72/180 |
| 3,305,270 | A | 2/1967 | Annipajo | |
| 4,471,641 | A * | 9/1984 | Mitchell | 72/132 |
| 5,319,952 | A * | 6/1994 | Cadney | 72/181 |
| 5,787,748 | A * | 8/1998 | Knudson et al. | 72/181 |
| 5,829,294 | A * | 11/1998 | Bradbury et al. | 72/176 |
| 6,148,654 | A * | 11/2000 | Jensen et al. | 72/181 |
| 6,282,932 | B1 * | 9/2001 | Surina et al. | 72/7.6 |
| 6,644,086 | B1 * | 11/2003 | Bodnar | 72/181 |
| 6,647,754 | B2 * | 11/2003 | Bodnar et al. | 72/181 |
| 7,004,001 | B2 * | 2/2006 | Barnes | 72/181 |
| 2003/0024290 | A1 * | 2/2003 | Bodnar et al. | 72/181 |
| 2007/0137276 | A1 | 6/2007 | Meyer | |

OTHER PUBLICATIONS

International Search Report from PCT/US2010/001855 dated Sep. 1, 2010; two pages.

* cited by examiner

*Primary Examiner* — Dana Ross
*Assistant Examiner* — Onekki Jolly
(74) *Attorney, Agent, or Firm* — McCormick, Paulding & Huber LLP

(57) ABSTRACT

A roll former has a plurality of paired die assemblies spaced apart across a midline of the roll former, and a web of material is fed through the roll former along the midline for operations by the die assemblies. The spacing between each pair of die assemblies is uniformly adjustable by way of mounting the die assemblies on collector plates movable toward and away from each other by linear actuators such as jack screws. Smoothness of movement is enhanced by supporting the collector plates only on the linear actuators. Precision of positioning is enhanced by using jack screws as the linear actuators.

18 Claims, 5 Drawing Sheets

CONTINUOUSLY SMOOTHLY ADJUSTABLE AND SELF-ALIGNING VARIABLE WIDTH ROLL FORMING APPARATUS

CROSS-REFERENCE TO RELATED APPLICATIONS

This application claims the benefit of U.S. Provisional Application Ser. No. 61/221,277, filed on Jun. 29, 2009, which is herein incorporated by reference in its entirety.

FIELD OF THE INVENTION

The invention relates generally to a variable width roll forming apparatus capable of forming a continuous web of sheet material as the web passes through a plurality of matching die rolls, and more particularly to a variable width roll forming apparatus which is capable of varying the spacing between matching die rolls, as well as compensating for variations in the width of the web.

BACKGROUND OF THE INVENTION

Known roll forming machinery usually has a plurality of sets of roll dies, typically arranged in upper and lower matching pairs, and usually spaced apart along the length of the machine on roller stands. Typically, the roller dies at one stand will produce a continuous formation in the web, and the roller dies of the next stand will produce another formation, or for example increase the angle of the formation which has already been started at the previous stand and so on.

A wide variety of commercial and other products are made on such roll forming machines, such as roof decking siding, as well as a large number of components for consumer equipment. The shapes may simply be webs with edge formations formed along one edge or both, or may be C sections or U sections but in many cases consist of relatively complex formations with longitudinal formations being formed along the length of the web, side by side.

Generally speaking at each stand of rolls there are two lower dies and two upper dies arranged in pairs, on either side of a central web axis to form thereby various bends or shapes in the web. The lower dies engage the underside of the web and the upper dies engage the upper side of the web. The dies have circular shapes, and are mounted on rotatable axles so that the dies can rotate at the same speed as the sheet metal. A gear drive mechanism is coupled to the dies so as to drive them at the speed of the sheet metal.

In order to keep capital costs low, it is desirable to use the same roller dies for forming finished products from webs of varying widths. Thus, spacing between opposing roller die stands may need to be increased or diminished according to the width of the web being formed. In the past, each of the stands situated on either side of the web would have to be manually moved further apart, or closer together, to account for the width of the new web to be processed. However, as will be readily appreciated, it was time consuming to manually dismantle the arrangement of dies for one web width, and then reassemble the dies with a greater or lesser number of rolls between them to suit the new web width.

Commonly assigned U.S. Pat. No. 6,647,754, titled "Variable Width Roll Forming Apparatus", herein incorporated by reference in its entirety, discloses several embodiments of a roll forming machine that is capable of quickly moving groups of roller stands, on either side of a metal web, either farther apart or closer together to accommodate webbing of differing widths.

In a preferred embodiment disclosed by U.S. Pat. No. 6,647,754, as shown in FIG. 1, a variable width roll forming apparatus, having an upstream end U and a downstream end D, includes opposed groups of upper and lower roller die pairs arranged on a base B. Each lower roller die is mounted through a collector plate within a sleeve that is mounted in a side plate. The lower roller dies are capable of axial and rotary movement within the sleeves, and the sleeves are axially movable relative to the side plates. Matching groups of upper roller dies are mounted through adjustment blocks that are bolted to the collector plates. Each collector plate is mounted on guide pins and bushings extending orthogonally from the corresponding side plate, and is movable toward and away from the corresponding side plate by operation of a jack screw against an internally-threaded fitting of the collector plate, whereby the distance between opposing pairs of collector plates can be easily adjusted. As is commonly accepted in the art, while the jack screw exerts force on the collector plate orthogonal to the side plate, the bushings and guide pins support the collector plate against forces transverse to the jack screw axis and parallel to the side plate. This distribution of transverse forces away from the jack screw is generally believed to prevent binding of the jack screw in the threads of the collector plate fitting. It also is generally believed that at least one guide pin and bushing are required in order to restrain rotation of the collector plate under torque supplied via the jack screw.

However, in practice, it has been found that the guide pins and bushings do not adequately ensure smooth and continuous motion of the collector plates toward and away from the side plates or each other.

BRIEF SUMMARY OF THE INVENTION

Accordingly, it is desirable to provide a variable width roll forming apparatus in which the collector plates can be moved smoothly and continuously toward and away from the side plates and each other.

After diligent investigation, it has been discovered that the traditional arrangement of jack screw, guide pins, and bushings can often result in frictional binding of a collector plate along one or more of the guide pins. In particular, the collector plate will tend to bind on a guide pin that is even slightly out-of-parallel with the jack screw. Since the guide pins are subject to forces transverse to the jack screw axis, while the jack screw ideally is not subject to transverse loading, parallelism of the guide pins to the jack screw varies depending on the distance between the collector plate and the side plate. In particular, as the collector plate moves further from the side plate, it becomes increasingly likely that one or more guide pins will bend elastically out of alignment with the jack screw, resulting in frictional binding.

It has further been discovered that frictional binding of the collector plate on a guide pin produces a torque on the collector plate transverse to the axis of the jack screw. This transverse torque twists the collector plate bushings out of alignment with the guide pins, leading to a further bind-up of the collector plate on additional guide pins that is relieved only when torque on the jack screw exceeds the frictional drag exerted by the guide pins on the bushings.

Accordingly, it would be desirable to distribute loads transverse to the jack screw axis so as to maintain the jack screw and the guide pins in alignment, regardless of spacing between the collector plate and the side plate. However, due to the differing mechanical cross-sections of the threaded jack screw and the cylindrical guide pins, it has not proven practicable to achieve the desired distribution of loading by varying the guide pin and jack screw dimensions.

Thus, according to an embodiment of the present invention, a variable width roll forming apparatus includes opposed pairs of collector plates, each collector plate being mounted to a corresponding side plate only by a plurality of jack screws engaged into a corresponding plurality of internally-threaded collector plate fittings.

It has further been discovered that, given a sufficient number of jack screws, and given sufficient rotational synchronicity among the jack screws, the collector plate can be supported against forces transverse to the jack screw axes and can be driven toward and away from the side plate along the jack screw axes, without requiring a guide pin and bushing to restrain rotation of the collector plate.

It has also been found that a planar dispersed array of jack screws, wherein a single line cannot be traced transverse to all of the jack screw axes, advantageously reduces transverse loadings on the jack screws due to torque transferred from each jack screw to the collector plate.

Accordingly, an improved adjustment mechanism includes a collector plate movably mounted to a side plate by a plurality of jack screws disposed in a dispersed planar array, rotation of the plurality of jack screws being synchronized by means of a chain engaging a corresponding plurality of jack screw sprockets.

These and other objects, features and advantages of the present invention will become apparent in light of the detailed description of the best mode embodiment thereof, as illustrated in the accompanying drawings.

DETAILED DESCRIPTION OF PREFERRED EMBODIMENTS

Figure 1:
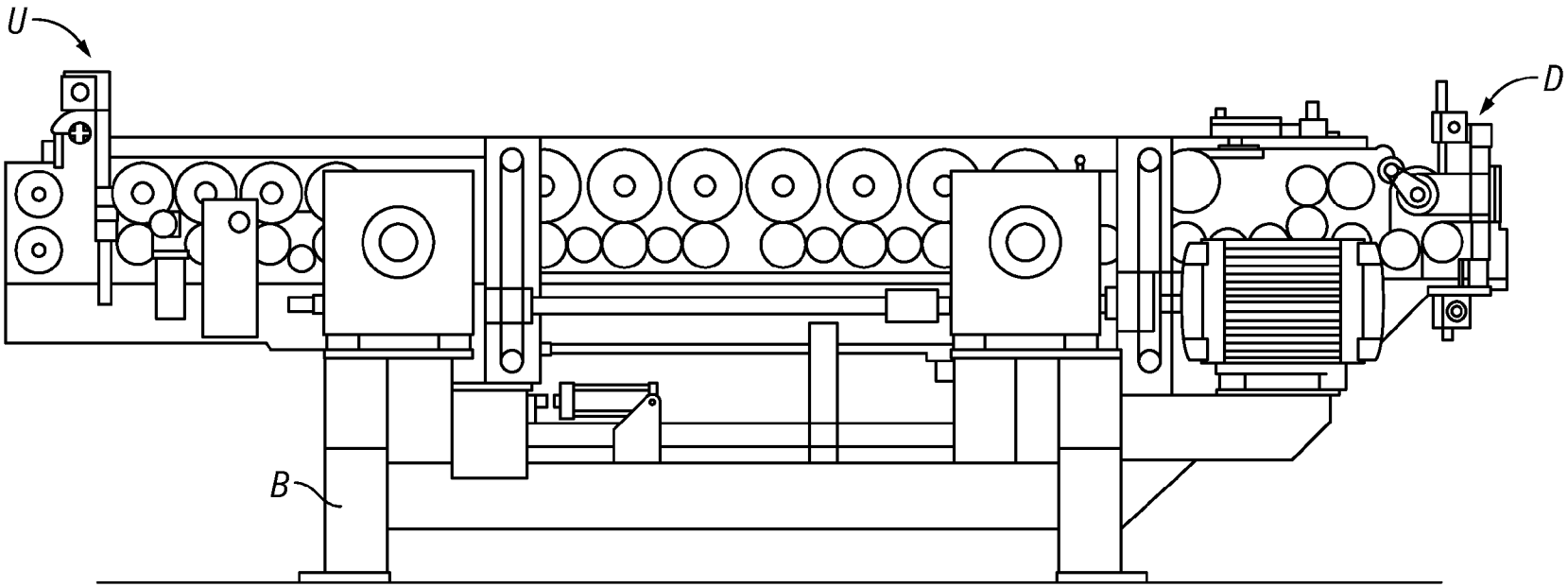
FIG. 1 (Prior Art)
FIG. 1 is an exterior side view of a known variable width roll forming apparatus.
Figure 2:
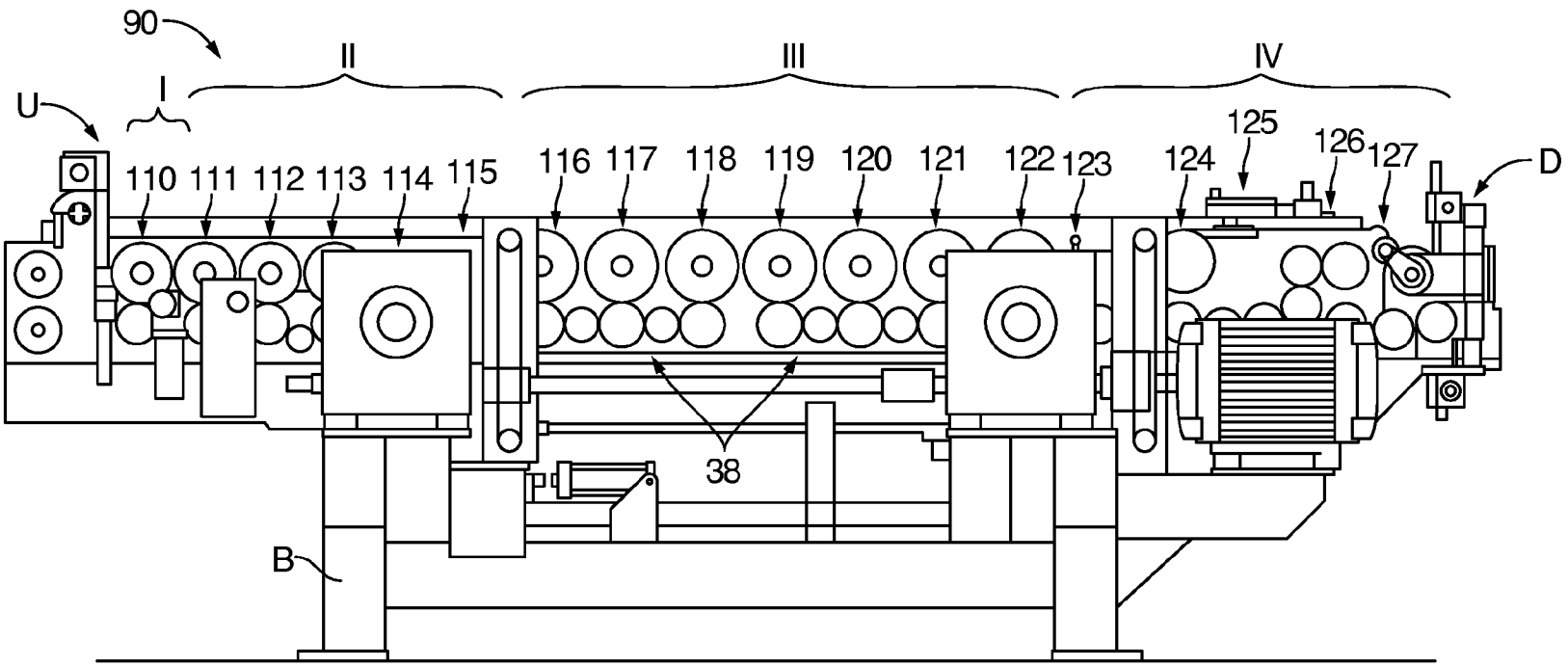
FIG. 2 Prior Art
FIG. 2 is an exterior side view of a variable width roll forming apparatus according to an embodiment of the present invention.

FIG. 2 illustrates an exterior side view of a variable width roll forming apparatus 90, according to one embodiment of the present invention. As depicted in FIG. 2, the roll forming apparatus comprises a base indicated generally as B, defining an upstream end U, and a downstream end D, and the web sheet metal passes from left to right, from the upstream end U, to the downstream end D, continuously, while being progressively roll formed.

Roll forming of the web is performed progressively at a series of roller die stands indicated generally as 110, 111, 112, 113, 114, 115, 116, 117, 118, 119, 120, 121, 122, 123, 124, 125, 126, and 127. The stands are mounted on the base B, in a manner to be described, at spaced apart intervals along the path of the web. The roller die stands are mounted in five groups: Group I, comprised of stand 110, is the lead in or pinch roll section where the flat web is gripped and driven along the path to the rest of the rolls; Groups II, comprised of stands 111, 112, 113, 114 and 115, and III, comprised of stands 116, 117, 118, 119, 120, 121, and 122, are forming dies which function to form the progressive bends in the web. Groups IV and V, comprised of stands 123, 124, 125, 126 and 127, perform finishing and straightening actions. It will be readily appreciated that stands 110-127 each comprise a pair of roller dies situated on either side of the web. That is, stand 110 comprises dies 110 A and 110 B on opposing sides of the web, stand 111 includes 111 A and 111 B on opposing side of the web, and so on. Moreover, each stand, for example 110 A and 110 B, are themselves comprised of matching upper and lower dies for contact with the upper and lower planes of the web, respectively.

As was discussed previously, it has been known to mount all of the matching upper and lower dies, for each of the stand Groups I, II, III, IV and V, on one side of the roll forming apparatus 90 through a continuous side plate 38. The counterpart matching upper and lower dies for each of the stand Groups I, II, III, IV and V are themselves mounted through a similar continuous side plate 40 (illustrated in FIG. 2).

Figure 3:
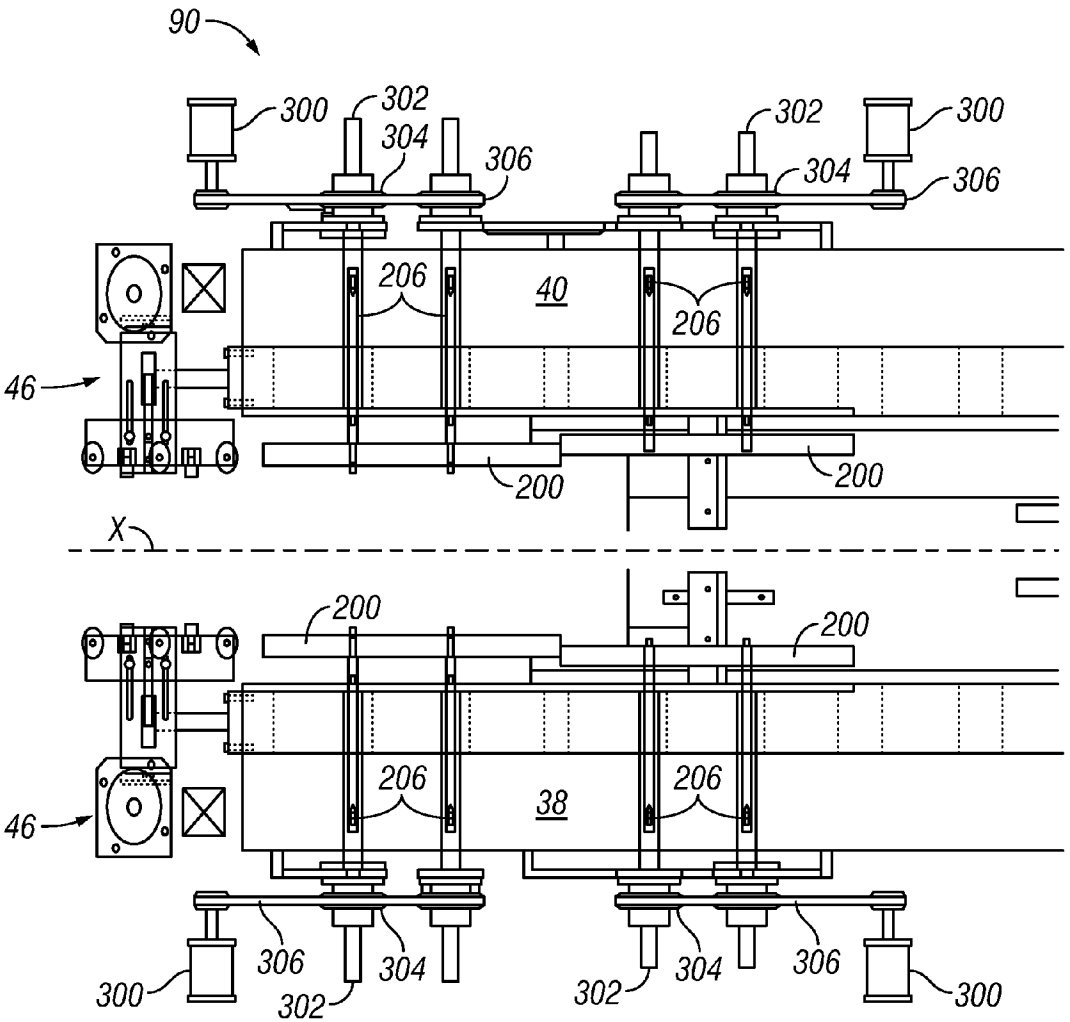
FIG. 3 is a top, partial cross-sectional planar view of the variable width roll forming apparatus depicted in FIG. 2.

Turning to FIGS. 2 and 3 in combination, it will be readily appreciated that by mounting the upper and lower dies on each side of the roll forming apparatus 90 to separate and continuous side plates 38 and 40 on either side of the metal web, the distance separating the side plates 38 and 40 may be adjusted, along the entire length of the roll forming apparatus 90, with a single movement of either the side plate 38 or the side plate 40. As depicted in FIG. 3, a transverse power drive means 46 operates to move the plates 38 and 40 together or apart, as necessary, to accommodate webs of varying widths. The transverse power drive means 46 may be comprised of any known drive mechanism, such as a rotary encoder or the like, without departing from the broader aspects of the present invention.

Thus, the roll forming apparatus 90 need not coordinate the movement and positioning of several different side plates on each side of the roll forming apparatus 90 during operation, thereby making both the manufacture and operation of the roll forming apparatus 90 less expensive and less complex. Moreover, having a single side plate 38/40 on each side of the roll forming apparatus 90 enhances rigidity and therefore mitigates the warping and bending stresses experienced by the roll forming apparatus 90 during normal operation.

However, the single side plate construction of the roll forming apparatus 90 initially restricts the roll forming apparatus 90 to define a uniform separation distance between matching die stands on either side of an axis of movement X of the web. As was explained previously, it is oftentimes necessary to orient a given station or Group of the roll forming apparatus 90 to have a differing separation distance, or width, than the station either preceding or following the given station or Group. A number of collector plates 200 can be used for this purpose.

Figure 4:
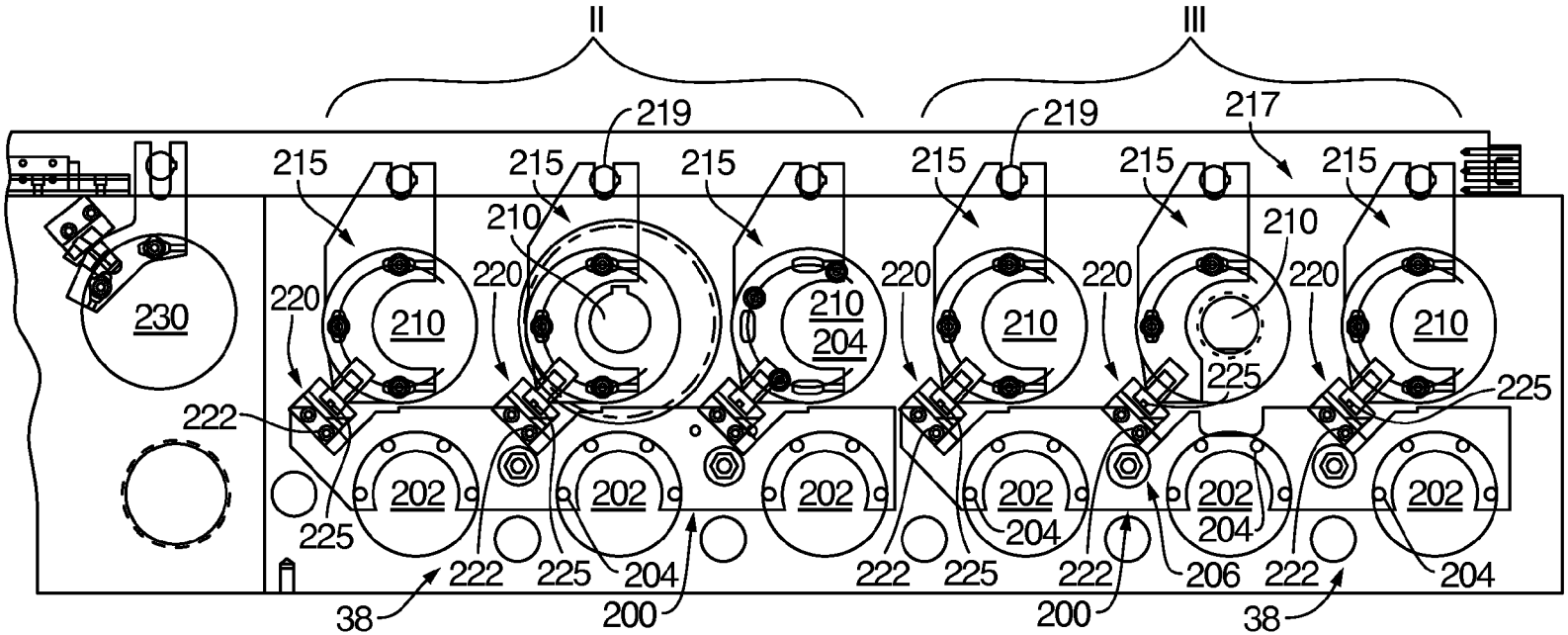
FIG. 4 Prior Art
FIG. 4 is a partial interior elevational view of the variable width roll forming apparatus depicted in FIG. 2.

FIG. 4 is a partial interior side view of the roll forming apparatus 90, illustrating the use of the collector plates 200. As depicted in FIG. 4, a plurality of lower dies of, for example, Groups II and III are fixed to separate collector plates 200. The lower dies 202 are each mounted within a sleeve that, in turn, is mounted within the side plate 38 (40). Each of the sleeves themselves is provided with bearings or the like and is capable of axial movement relative to the side plate 38 (40). The collector plates 200 are secured to the sleeves of the lower dies 202 via a plurality of bolts 204 or the like and are themselves secured to the side plate 38 (40) by one or more jack screws 206.

As depicted in FIG. 4, operation of the jack screws 206 in a first direction will cause movement of the collector plates 200 in a direction away from the planar surface of the side plate 38 (40), while operation of the jack screws 206 in a second direction will cause movement of the collector plates 200 in a direction towards the planar surface of the side plate 38 (40). As will be appreciated, the sleeves of the lower dies 202 will move in a rectilinear and axial direction, in concert with the movement of the collector plates 200.

Thus, the collector plates 200 enable the roll forming apparatus 90 to selectively control the effective spacing between die stands housed within either the side plate 38 or and the side plate 40. In this manner, the roll forming apparatus 90 is capable of accommodating a web whose width varies as the web is fed through the roll forming apparatus 90, while still maintaining the rigidity of the roll forming apparatus 90 as a whole.

In order to maintain alignment between the lower dies 202 and the matching upper dies 210, each of the upper matching dies in FIG. 4 is carried on an upper shaft housed within an eccentric bearing sleeve, and is both slidably and rotatably mounted in the side plate 38. The sleeves define shaft openings that are offset from the central axis of the sleeves so that rotation of the upper sleeves causes a corresponding displacement of the upper dies in a vertical direction, either away or towards the lower dies 202.

Additionally, a plurality of adjustment blocks 220 are mounted to the collector plates 200 via bolts 222, not to the side plate 38 (40). With such a configuration, as the collector plates 200 are shifted by operation of the jack screws 206, the blocks 220 are themselves carried either away or towards the side plate 38 (40). The ensuing interplay between the generally diagonal slot formed in the block 220, and the cam roller 225 that is fixed to the arm 215, causes a corresponding horizontal, or axial, movement of the upper dies 210.

Thus, movement of the collector plates 200 not only operates to shift a selected number of lower dies 202 in a horizontal, or axial, direction, but also precipitates an equal displacement of the matching upper dies 210, thereby maintaining proper registration between the upper and lower dies, 210 and 202 regardless of the movement of the collector plates 200.

Returning to FIG. 3, the selective implementation of the collector plates 200 is shown. As depicted in FIG. 3, the operational width of the roll forming apparatus 90 may be selectively adjusted via operation of the jack screws 206 under the control of a motor and encoder device 300. Importantly, only the jack screws 206, mounted through and orthogonal to the corresponding side plate, support the collector plate. The jack screws support the collector plate against forces both along and transverse to the jack screw axes. Thus, binding of guide pins in the collector plates is prevented. Preferably, the jack screws are arranged in a planar array, such that any line parallel to the collector plate can intersect no more than three of the jack screws. More preferably, the jack screws are arranged in a staggered planar array, such that any line parallel to the collector plate can intersect no more than two of the jack screws. Dispersed planar array arrangement seems to further mitigate the problem of binding on the jack screws.

Figure 5:
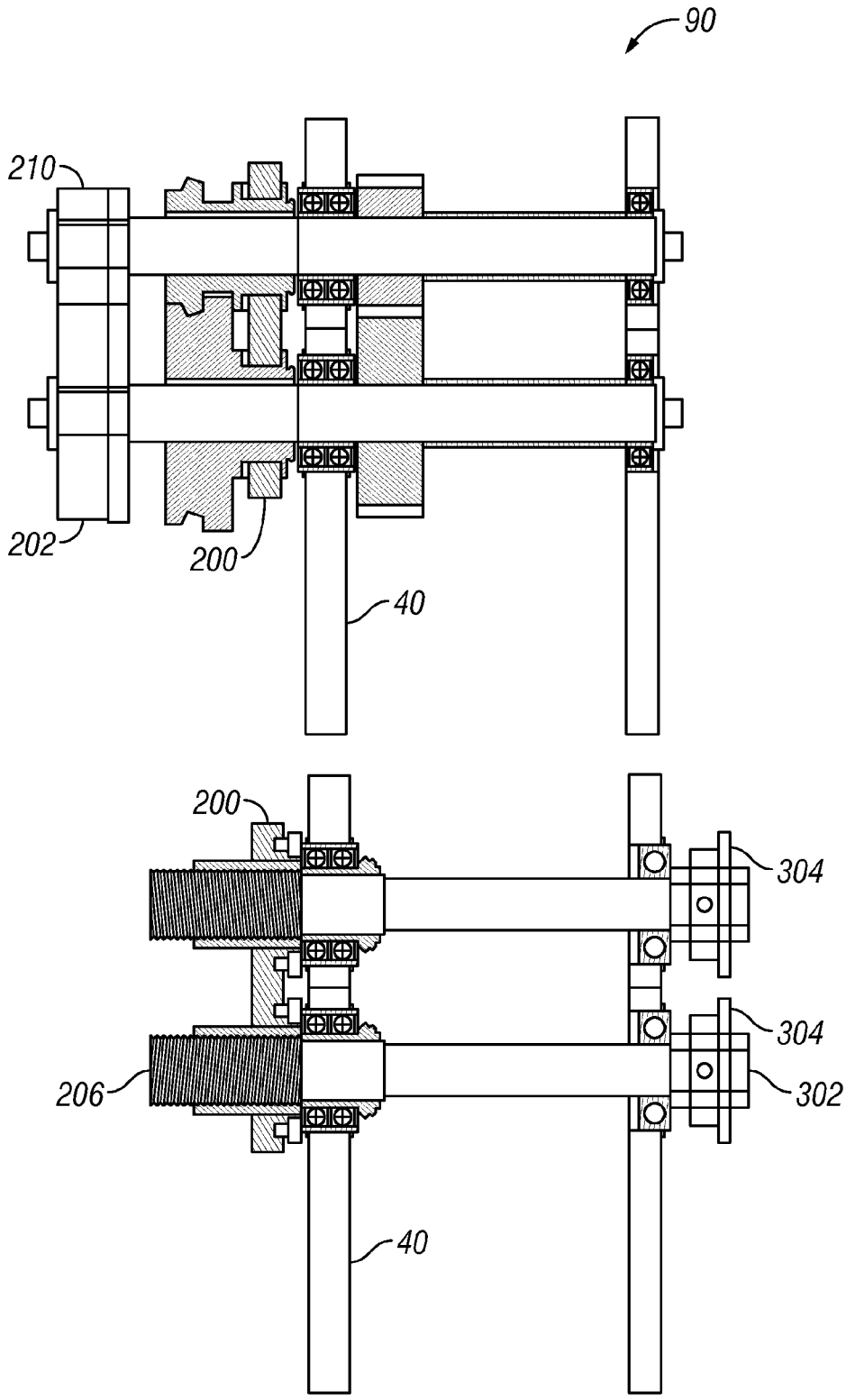
FIG. 5 is a partial cross-sectional planar view of a collector plate driven and supported only by a plurality of jack screws, according to an embodiment of the present invention.

As shown in FIGS. 3 and 5, each jack screw 206 is operated by rotation of a shaft 302. Each shaft 302 is keyed to a drive sprocket 304. The drive sprockets 304 for each collector plate 200 are synchronously driven by the corresponding motor and encoder device 300 via a chain 306. Operation of the chain 306 and sprockets 304 mitigates even slight variations in rotation among the plurality of jack screws, thereby preventing frictional binding of the jack screws in the collector plate fittings.

Accordingly, the present invention provides a variable-width roll forming apparatus wherein collector plates carrying upper and lower roller die pairs are smoothly and continuously movable toward and away from each other without frictional binding.

What is claimed is:

1. A variable width roll forming apparatus for progressively forming a web of material directed therethrough, said roll forming apparatus comprising:

a first side plate extending substantially an entire length of said roll forming apparatus;

a second side plate extending substantially an entire length of said roll forming apparatus, said first side plate and said second side plate being oriented on opposing sides of an axis of movement of said web substantially equidistant from one another;

a plurality of roller die assemblies disposed in apertures formed in said first side plate and said second side plate, said roller die assemblies each including an upper die assembly and a lower die assembly;

an adjusting apparatus for selectively changing a separation width between predetermined roller die assemblies in said first side plate and said second side plate, said adjusting apparatus including at least a first collector plate disposed in one of said first side plate and said second side plate and supporting one of said upper die assembly and said lower die assembly, said adjusting apparatus further including a jack screw assembly entirely supporting said first collector plate within the one of said first side plate and said second side plate, and further including a shaft keyed to a drive sprocket and an associated chain, wherein said jack screw assembly is operated by rotation of said shaft, wherein said roll forming apparatus defines thereby at least two differing widths between roller die assemblies disposed in said first side plate and said second side plate while maintaining said substantially equidistant spacing between said first side plate and said second side plate, and operation of said adjusting apparatus causes said first collector plate to move in a direction substantially orthogonal to said one of said first side plate and said second side plate.

2. The variable width roll forming apparatus according to claim 1, wherein said adjusting apparatus includes said first collector plate fixed to one of said upper die assembly and said lower die assembly of two roller die assemblies disposed in said first side plate, and a second collector plate fixed to said upper die assembly and said lower die assembly of two roller die assemblies disposed in said second side plate.

3. The variable width roll forming apparatus according to claim 2, wherein: said first collector plate and said second collector plate are mounted in opposition to one another on either side of said axis of movement of said web.

4. The variable width roll forming apparatus according to claim 2, wherein: said adjusting apparatus includes a first drive mechanism for operatively linking said first collector plate to said first side plate, and a second drive mechanism for operatively linking said second collector plate to said second side plate.

5. The variable width roll forming apparatus according to claim 4, wherein: said first drive mechanism and said second drive mechanism each include a motor and encoder device.

6. The variable width roll forming apparatus according to claim 4, wherein: said first drive mechanism and said second drive mechanism include a common motor and encoder device.

7. The variable width roll forming apparatus according to claim 1, further comprising:

a cam block assembly secured to said first collector plate;

a first cam roller operatively fixed to one of said upper die assembly and said lower die assembly not fixed to said first collector plate, said cam roller being slidably received in a groove formed in said cam block assembly; and wherein operation of said adjusting apparatus causes said cam roller to move along said groove, thereby causing one of said upper die assembly and said lower die assembly not fixed to said first collector plate to move in registration with said one of said upper die assembly and said lower die assembly fixed to said first collector plate.

8. The variable width roll forming apparatus according to claim 1 wherein: one of said upper die assembly and said lower die assembly not fixed to said first collector plate includes an eccentric bearing sleeve.

9. A variable width roll forming apparatus for progressively forming a web of material directed therethrough, said roll forming apparatus comprising:

a first side plate extending substantially an entire length of said roll forming apparatus;

a second side plate extending substantially an entire length of said roll forming apparatus, said first side plate and said second side plate being oriented on opposing sides of an axis of movement of said web substantially equidistant from one another;

a plurality of roller die assemblies disposed in apertures formed in said first side plate and said second side plate, said roller die assemblies each including an upper die assembly and a lower die assembly;

an adjusting apparatus for selectively changing a separation width between predetermined roller die assemblies in said first side plate and said second side plate, said adjusting apparatus including at least a first collector plate disposed in one of said first side plate and said second side plate and supporting one of said upper die assembly and said lower die assembly, said adjusting apparatus further including a jack screw assembly entirely supporting said first collector plate within the one of said first side plate and said second side plate, said jack screw assembly including a plurality of jack screws and threaded sleeves extending orthogonally from the one of said first side plate and said second side plate, said plurality of jack screws and threaded sleeves being arranged in a dispersed planar array, and said adjusting apparatus further including a shaft keyed to a drive sprocket and an associated chain, wherein said plurality of jack screws are operated by rotation of said shaft, wherein said roll forming apparatus defines thereby at least two differing widths between roller die assemblies disposed in said first side plate and said second side plate while maintaining said substantially equidistant spacing between said first side plate and said second side plate, and operation of said adjusting apparatus causes said first collector plate to move in a direction substantially orthogonal to said one of said first side plate and said second side plate.

10. A variable width roll forming apparatus for progressively forming a web of material directed therethrough, said roll forming apparatus comprising:

a first side plate extending substantially an entire length of said roll forming apparatus;

a second side plate extending substantially an entire length of said roll forming apparatus, said first side plate and said second side plate being oriented on opposing sides of an axis of movement of said web substantially equidistant from one another;

a plurality of roller die assemblies disposed in apertures formed in said first side plate and said second side plate, said roller die assemblies each including an upper die assembly and a lower die assembly;

an adjusting apparatus for selectively changing a separation width between predetermined roller die assemblies in said first side plate and said second side plate, said adjusting apparatus including at least a first collector plate disposed in one of said first side plate and said second side plate and supporting one of said upper die assembly and said lower die assembly, said adjusting apparatus further including a jack screw assembly entirely supporting said first collector plate within the one of said first side plate and said second side plate, said jack screw assembly including a plurality of jack screws and threaded sleeves extending orthogonally from the one of said first side plate and said second side plate, said plurality of jack screws and threaded sleeves being arranged in a staggered planar array, wherein said roll forming apparatus defines thereby at least two differing widths between roller die assemblies disposed in said first side plate and said second side plate while maintaining said substantially equidistant spacing between said first side plate and said second side plate, and operation of said adjusting apparatus causes said first collector plate to move in a direction substantially orthogonal to said one of said first side plate and said second side plate.

11. The variable width roll forming apparatus according to claim 1, wherein the jack screws are arranged in a dispersed staggered planar array.

12. The variable width roll forming apparatus according to claim 11, wherein said adjusting apparatus includes said first collector plate fixed to one of said upper die assembly and said lower die assembly of two roller die assemblies disposed in said first side plate, and a second collector plate fixed to said upper die assembly and said lower die assembly of two roller die assemblies disposed in said second side plate.

13. The variable width roll forming apparatus according to claim 12, wherein: said first collector plate and said second collector plate are mounted in opposition to one another on either side of said axis of movement of said web.

14. The variable width roll forming apparatus according to claim 12, wherein: said adjusting apparatus includes a first drive mechanism for operatively linking said first collector plate to said first side plate, and a second drive mechanism for operatively linking said second collector plate to said second side plate.

15. The variable width roll forming apparatus according to claim 14, wherein: said first drive mechanism and said second drive mechanism each include a motor and encoder device.

16. The variable width roll forming apparatus according to claim 14, wherein: said first drive mechanism and said second drive mechanism include a common motor and encoder device.

17. The variable width roll forming apparatus according to claim 11, further comprising:

a cam block assembly secured to said first collector plate;

a first cam roller operatively fixed to one of said upper die assembly and said lower die assembly not fixed to said first collector plate, said cam roller being slidably received in a groove formed in said cam block assembly; and wherein operation of said adjusting apparatus causes said cam roller to move along said groove, thereby causing one of said upper die assembly and said lower die assembly not fixed to said first collector plate to move in registration with said one of said upper die assembly and said lower die assembly fixed to said first collector plate.

18. The variable width roll forming apparatus according to claim 11 wherein: one of said upper die assembly and said lower die assembly not fixed to said first collector plate includes an eccentric bearing sleeve.

* * * * *